US006261146B1

(12) United States Patent
Spector

(10) Patent No.: US 6,261,146 B1
(45) Date of Patent: Jul. 17, 2001

(54) PACKAGE CONTAINING A SHRUNKEN BODY

(76) Inventor: Donald Spector, 380 Mountain Rd., Union City, NJ (US) 07080

( * ) Notice: Subject to any disclaimer, the term of this patent is extended or adjusted under 35 U.S.C. 154(b) by 0 days.

(21) Appl. No.: 09/359,730

(22) Filed: Jul. 22, 1999

Related U.S. Application Data

(63) Continuation-in-part of application No. 09/129,991, filed on Aug. 6, 1998, now Pat. No. 5,961,363, which is a continuation-in-part of application No. 09/674,871, filed on May 8, 1998, now Pat. No. 5,897,418.

(51) Int. Cl.[7] ..... A63H 3/00; A63H 3/36

(52) U.S. Cl. ..... 446/73; 446/385

(58) Field of Search ..... 446/81, 73, 368, 446/370, 387, 385, 268; 273/DIG. 1, DIG. 2, DIG. 8

(56) References Cited

U.S. PATENT DOCUMENTS

| | | | | |
|---|---|---|---|---|
| 2,760,302 | * | 8/1956 | Cheskin | 446/387 |
| 4,033,070 | * | 7/1977 | Strongin et al. | 446/61 |
| 4,106,657 | * | 8/1978 | Dogliotti | 446/81 X |
| 4,233,775 | * | 11/1980 | Neufeld | 446/370 |
| 4,881,915 | * | 11/1989 | Liaw | 446/368 X |
| 6,026,527 | * | 2/2000 | Pearce | 5/654 |

* cited by examiner

*Primary Examiner*—D. Neal Muir

(57) ABSTRACT

A package containing a humanoid or animal-like figure or other shaped object whose body is formed of open-cell, flexible-foam plastic material which when compressed then expels air therefrom to cause the body to shrink so that it can be stuffed into a small container. When the body is removed from the container it then inhales air to assume its normal full scale form. To enhance the shrinkability of the body so that it can be stuffed into a smaller container, dispersed throughout the flexible-foam body are air pockets that are much larger than the open cells.

9 Claims, 2 Drawing Sheets

PACKAGE CONTAINING A SHRUNKEN BODY

RELATED APPLICATION

This application is a continuation-in-part of the Spector application Ser. No. 09/129 991, filed Aug. 6, 1998 now U.S. Pat. No. 5,961,363 entitled "Package Containing Shrunken Figure" which in turn is a C-I-P of the application Ser. No. 09/674,871, filed May 8, 1998 entitled "Test Tube Doll Package," now U.S. Pat. No. 5,897,418 granted Apr. 7, 1999.

BACKGROUND OF THE INVENTION

1. Field of Invention:

This invention relates generally containing humanoid or animal-like figures or shaped objects, and more particularly to a package in which the body of the figure or object is formed of flexible foam plastic material that is highly compressible, making it possible to shrink the object to a degree where can be stuffed into a stall container.

2. Status of Prior Art:

My prior U.S. Pat. No. 5,897,418 entitled "Test Tube Doll Package" discloses a doll packaged in a test tube, the doll being constituted by a figure of a baby formed of open-cell, flexible-foam plastic material whose compressibility is such that when the baby doll is squeezed into a shrunken form and thereafter released, it recovers its normal shape and size. When the doll is compressed, air is expelled therefrom and the doll is then in a shrunken state so that it can be stuffed into the test tube which is then sealed by a stopper. To play with the doll, the stopper is removed and the shrunken figure is taken out of the test tube, the doll then inhaling air to recover its normal size and shape.

My copending application, above-identified, entitled "Package Containing Shrunken Figure" discloses a similar package except that the shrunken body which may be in the form of a figure or other shaped object, is stuffed into a small container whose form is thematically related to the body.

A flexible foam body shaped to create a humanoid or animal-like figure can be produced in relatively large sizes suitable for play. Were it possible to shrink a large figure of this type so that it could be stuffed into a relatively small container, then when the stuffed figure is removed from the container and springs back to life to recover its normal size and shape, the effect of this transformation would be highly dramatic.

But this effect cannot be achieved with a shaped body formed of conventional open-cell, foam plastic material, even with of low-density material. Foam plastics range in density from less than one pound per cubic foot to more than fifty pounds. These plastics, when flexible, range in cellular formation from open or interconnecting cells to closed cells.

A shaped body in accordance with the invention is formed of open-cell, flexible foam plastic material, hence this body is compressible and may therefore be caused to shrink. Compression acts to expel air from the open cells of the foam, and thereby collapse the cells to shrink the body.

The usual technique for producing open-cell, flexible-foam material, such as polyurethane, is to bring about an interaction between a polyester resin and a diisocyanate which then reacts with water to form a urethane polymer. Since carbon dioxide is generated in this reaction, this gas acts to foam the urethane resin to render it cellular.

A shaped figure formed of very low density flexible foam material can, by compression, be shrunk to a fraction of its original size and can therefore be stuffed into a very small container. But a very low density foam plastic figure is not acceptable as a play doll, for it is unduly soft and light and therefore insubstantial. But a similar figure formed of medium density foam plastic material would be sufficiently firm and substantial to function as a play doll. However, this medium density flexible-foam plastic figure, though compressible, cannot be shrunk to a sufficient degree to be stuffed into a very small container.

The shrinkability of a flexible, open-cell foam-plastic material depends on the amount of plastic included in the material relative to the amount of air entrapped therein. In conventional foam plastics, the open cells thereof are all of similar size and are distributed throughout the material. In a low-density foam, the cells are relatively large and the material is therefore more shrinkable than high density foam in which the cells are much finer. But low-density foams are not suitable for forming play dolls, for the reasons previously given.

SUMMARY OF INVENTION

In view of the foregoing, the main object of this invention is to provide a package in which a figure whose shaped body is formed of open-cell, flexible-foam plastic material is stuffed in a shrunken state into a small container whereby when the figure is thereafter removed from the container, it fully regains its original form.

A significant feature of the invention is that the size of the container is much smaller than the original size of the figure, whereby the transformation of the figure in its shrunken state in which it is stuffed into the container to its original state when the stuffed figure is removed from the container produces a striking effect.

More particularly, an object of this invention is to provide a shaped body of flexible open-cell, foam-plastic material whose shrinkability is enhanced so that the body can be stuffed into a very small container.

Also an object of the invention is to provide a container for a compressible foam plastic figure that it is adapted to squeeze the figure telescoping contained therein to further shrink it.

Briefly stated, these objects are attained by a package containing a humanoid or animal-like figure or other shaped object whose body is formed of open-cell flexible foam plastic material which when compressed then expels air therefrom to cause the body to shrink so that it can be stuffed into a small container. When the body is removed from the container it then inhales air to assume its normal size and shape. To enhance the shrinkability of the body so that it can be stuffed into a smaller container, dispersed throughout the flexible foam body are air pockets that are much larger than the open cells.

The container for the body is preferably formed of two telescoping sections adapted to receive the body in a partially shrunken state whereby the sections can then be drawn together to further telescope the sections and thereby further shrink the body.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
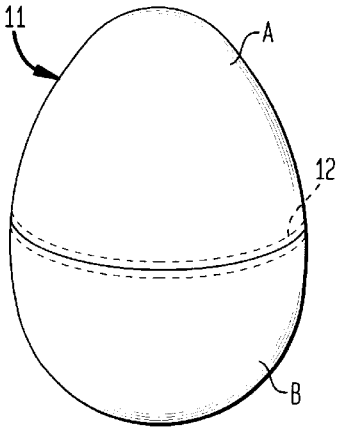
FIG. 1 is a perspective view of a package in accordance with the invention in which stuffed into an egg-shaped container is the figure of a dinosaur in a shrunken state.
Figure 2:
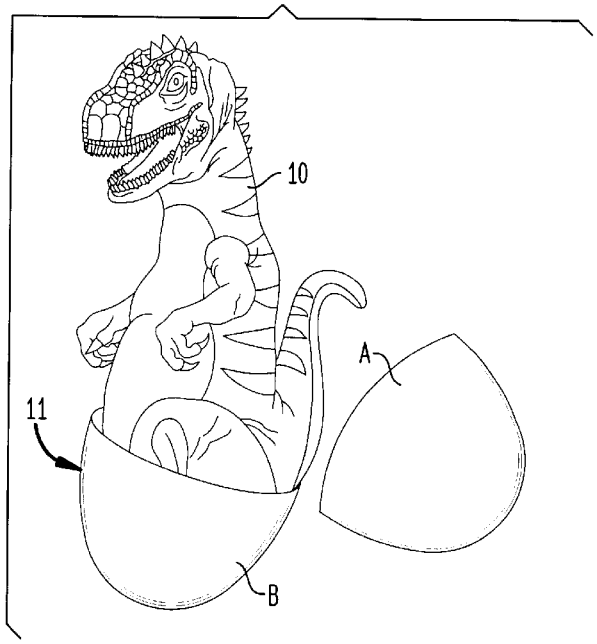
FIG. 2 shows the dinosaur emerging from the hatched egg.

Referring now to FIGS. 1 and 2, shown therein is a package in accordance with the invention formed by a FIG. 10 that is stuffed in a shrunken state into an egg-shaped container 11.

Egg-shaped container 11 which resembles a dinosaur egg is formed of separable half-sections A and B. These are held together by a band 12 of pressure-sensitive adhesive tape that encircles the abutting ends of the sections. Hence to open the egg, one has only to peel off the tape and separate the sections.

FIG. 10 which resembles a miniature dinosaur is molded of flexible, low-density, open-cell foam plastic material, such as polyurethene. This porous foam material is highly compressible yet its plasticity is such that regardless of the degree to which the figure is deformed under stress, the figure, when released, recovers its normal full size and shape. Thus if the figure normally has a height of 7 inches and a maximum girth of 5 inches, under compression, it can be shrunken to have a height of say 4 inches and a girth of 3 inches. Thus in a shrunken state, the dinosaur is almost ball-like in form and can be squeezed into a cavity in the container therefor.

The internal dimensions of the egg are close to those of the figure in the shrunken state, the length of the egg along its main axis being about three inches and the egg about its equator having a girth of about four inches.

When the foam-plastic figure is highly compressed to assume a shrunken state, air filling the open cells of the foam is expelled therefrom. The lower the density of the foam plastic material, the greater the degree to which it can be compressed. Thus the egg-shaped container 11 is thematically related to the figure, for the container resembles the egg from which the dinosaur figure is hatched.

When the egg-shaped container 11 is formed of two complementary halves A and B, as shown in FIG. 1, these halves can be molded of flexible, synthetic-plastic material of high strength, such as polyethylene or PVC. However, if one wishes to simulate the birth of a dinosaur which is a reptile, the container may be formed of a fairly brittle synthetic plastic material, so that instead of separating the two halves of the egg to release the dinosaur figure, one cracks the egg open to do so.

As noted in my above-identified co-pending application, a preferred package in accordance with the invention is a package in which the container for the foam plastic figure or object has a form which is thematically related to the figure or object.

Thus when the object is a football, the container therefor has the shape of a football. And when the object is an automobile, it is stuffed into a tire-shaped container.

The package is most impressive when the object or figure stuffed into the container is normally much larger than the container. Thus if the object stuffed into the container is formed of open-cell, foam-plastic material and is a full scale football, and this object is compressed and shrunken so that it can be stuffed into a small container that looks like a miniature football, then when the shrunken object is removed from this container and is transformed into a full scale football, this transformation is astounding.

Figure 3:
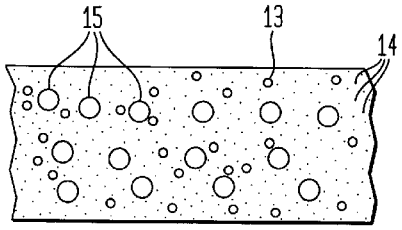
FIG. 3 is a section taken through the body of the dinosaur showing the structure of the flexible foam plastic material of which it is formed, the material having air pockets dispersed therein.

As shown in FIG. 3, the compressible body 13 of the figure or object to be included in a package in accordance with the invention is formed of flexible-foam plastic material. Distributed throughout this body a multitude of minute, open cells 14 having air entrapped therein. Hence when the flexible foam body is squeezed to shrink it, the air is expelled from the cells to collapse the cells, and when the pressure is released, the cells inhales air so that the body regains its normal size and shape.

In order to enhance the shrinkability of the body, dispersed throughout the flexible-foam plastic body 13 are air pockets 15 which are much larger than the cells in the multitude therein forming the plastic material. These air pockets, make it possible to shrink the body to a much greater degree than would be possible in the absence of air pockets, without however altering the density of the foam plastic material.

Thus if the density of the open-cell, flexible-foam material is such that the object or figure molded therefrom is firm and fairly heavy, the object or figure is then suitable for play. The presence of air pockets in the plastic body will not render it unsuitable for purposes of play.

For example, if the foam plastic object is a full-scale football, a very low density foam plastic for this purpose would not be acceptable, for then the football would be so light that a player could not throw it so that it would fly a fairly long distance in the air. But if the density of the plastic is sufficient to provide a throwable football, the presence of air pockets in the plastic material, while making it more shrinkable, will not impair its throwability.

Figure 4:
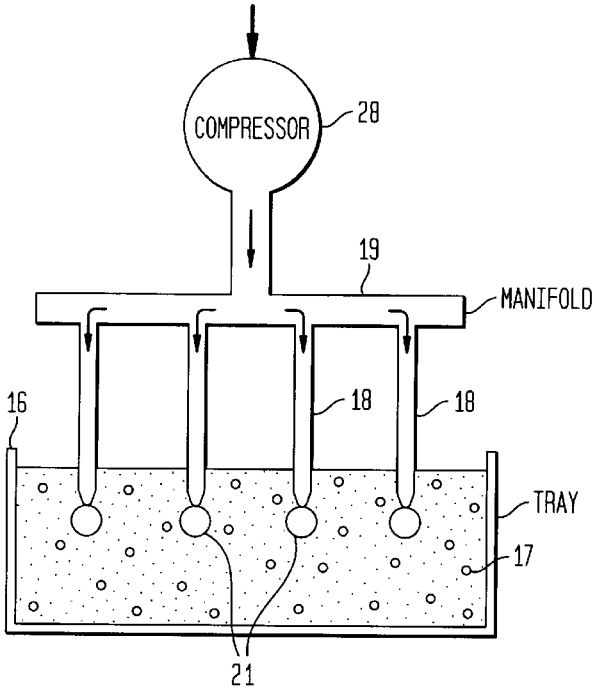
FIG. 4 schematically illustrates the means by which air pockets are created within the open-cell foam plastic material in the course of its production.

A preferred technique for introducing air pockets in the flexible foam material is shown in FIG. 4.

A conventional manufacturing procedure for producing foam plastic material is to mix a flowable resin and the various chemical components that react with the resin, the resultant mixture being then poured into a flat tray 16 in which the reactive mixture 17 then proceeds to foam and to rise within the tray. As the mixture rises in the tray, air is injected into the mixture by hypodermic needles 18 projecting from a manifold 19. Fed into this manifold is compressed air produced by an air compressor 20.

Air injected by the needles into the resin mixture 17 creates air pockets 21 therein which are dispersed throughout the mixture. Hence when the mixture cures, the resultant open-cell foam plastic body has air pockets dispersed therein enveloped by plastic containing much smaller air cells.

Another way of introducing air pockets into the foam plastic mixture resin is to lay down in the tray as the mixture rises therein, pre-formed slices of the same foam plastic material having holes die cut therein, each slice being like a slice of swiss cheese. Then when the mixture is cured, the slices become integrated with the open-cell foam plastic material to create air pockets therein.

When a figure or object whose foam plastic body has air pockets therein as well as a myriad of much smaller open cells is compressed to expel air both from the air pockets and from the open cells, it can then be shrunk to a significantly greater degree than a similar body that lacks these air pockets. As a consequence, the body can be shrunk to a marked degree, making it possible to stuff the body into a relatively small container.

Telescoping Container:

In order to shrink a figure or object in accordance with the invention so that it can be stuffed into a very small container, a fair amount of pressure is required for this purpose.

Figure 5:
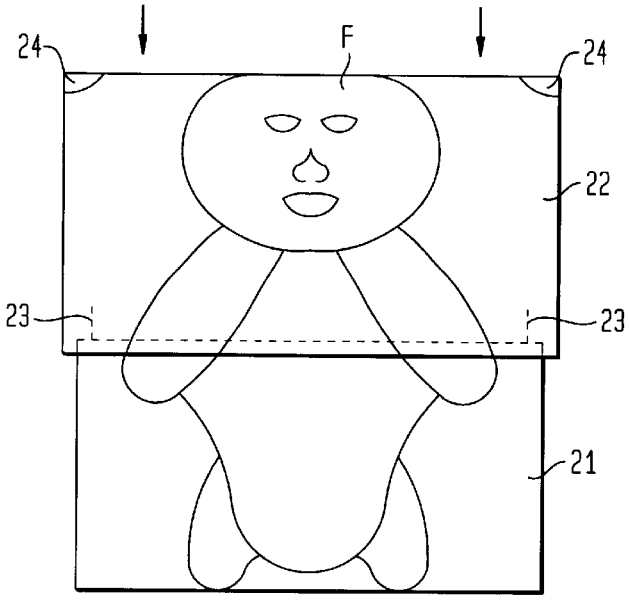
FIG. 5 illustrates a container in accordance with the invention for housing a shrunken figure, the container being formed of telescoping sections.
Figure 6:
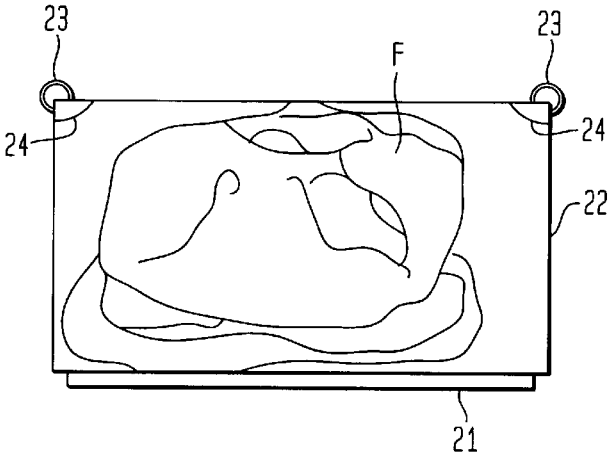
FIG. 6 illustrates the same container in its fully telescoped state in which the figure therein is further shrunken.

In a container, as shown in FIGS. 5 and 6, some of the pressure required to shrink the body so that it fits into the container is provided by the container itself.

The container illustrated in FIGS. 5 and 6 is formed by a lower half section 21 that telescopes into an upper half section 22. Lower section 21 is provided at its upper corners with projecting tabs 23 formed of bendable, ductile metal. Tabs 23 lie in registration with holes 24 at upper corners of the upper section 23.

Nested in the container is an open-cell, flexible-foam figure F which is normally much larger than the container and has therefore been shrunken by compression to fit into the container so that the lower portion of the figure is within lower section 21 and the upper portion is within upper section 22.

But the figure, as shown in FIG. 5, is not fully shrunken, and the container is not in its ultimate small size, for the lower section 21 is only slightly telescoped with respect to upper section 22.

In order to further shrink figure F and cause the container to assume its ultimate size and to maintain the container in this condition, pressure is applied to the container to cause its lower section to fully telescope into its upper section, as shown in FIG. 6.

In this state, the tabs 23 at the upper corners of lower section 21 projects through the holes 24 at the upper corners of upper section 22. The are then bent over to lock the sections together and to maintain the container in its reduced size.

When one wishes to remove figure F from the small container so that one can play with this figure, it is only necessary to unbend tabs 23 so that the upper section is decoupled from the lower section and the compressed figure within the sections is free to expand. This expansion raised upper section 22 above lower section 21 permitting the figure to inhale air and regain its normal full scale form.

Figure With Armature:

In the humanoid and animal-like figures previously described, the figure is molded of flexible open-cell foam plastic material so that it has, when not compressed, a predetermined size and shape and posture. Thus the figure could be that of a baby having its arms outstretched and its legs together with its head inclined to one side.

Figure 7:
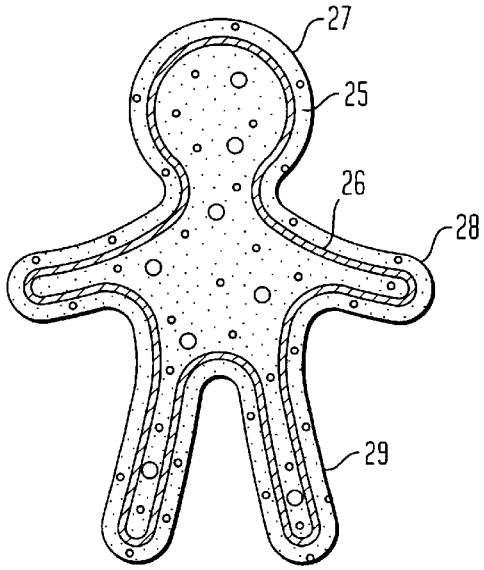
FIG. 7 illustrates a modified figure having a wire skeleton therein.

In the molded flexible foam plastic FIG. 25, shown in FIG. 7, embedded in the foam is an armature 26 formed of metal wire which extends from the head 27 through the arm appendages 28 and from these appendages to the leg appendages 29.

The metal wire forming the armature is of a ductile easily bendable metal which when bent remains in its bent state until it is again bent to assume a new state.

When therefore the figure is compressed to shrink it, the armature therein is bent by the compressive forces applied to the figure to conform to the figure in its shrunken state and to hold it in this state.

But when the shrunken figure is removed from its container and inhales air to assume its normal size and shape, this action reshapes the armature to conform to the normal size and shape of the figure.

Then a user by bending the head, arm and leg appendages of the figure can in doing so cause the figure to assume a new posture which will be maintained by the armature which was bent to conform to this new posture.

While there has been shown a preferred embodiment of a package containing a shrunken body in accordance with the invention, it will be appreciated that many changes and modifications may be made therein without, however, departing from the essential spirit thereof.

I claim:

1. A package for a play object comprising:

at least one object selected from the group consisting of humanoid figures, animal-like figures and other objects with a definite shape, said object having a body formed of flexible foam plastic material which is compressible to cause air to be expelled therefrom to shrink the object, said body having a plurality of collapsible air pockets dispersed therein which enhance the compressibility of the object so that it can be shrunk to form a small object; said air pockets being substantially larger than open cells inherent in the foam plastic material; and a container smaller than the object having the object compressed therein to maintain the object in a shrunken state, whereby when the object are removed from the container the object absorb air to regain their original form and size.

2. A package as set forth in claim 1, in which the container is in a form thematically related to the object.

3. A package as set forth in claim 1, in which the foam plastic is polyurethane.

4. A package as set forth in claim 1, in which myriad open cells are distributed throughout the body, and in which the air pockets are much larger than the cells.

5. A package as set forth in claim 1, in which the object is a dinosaur and the container is a dinosaur egg.

6. A package as set forth in claim 1, in which the container is formed of two telescoping sections which after the object is placed therein can be pressed together to further shrink the object.

7. A package as set forth in claim 6, further including means to lock the two sections of the container together when in a fully telescoped state.

8. A method of producing a body as set forth in claim 1, comprising the steps of bouncing a mixture of reacting components into a tray which then rises in the tray to form an open-cell foam plastic material, and injecting air into the resin mixture to form air pockets therein.

9. A package as set forth in claim 1, in which embedded in the figure is an armature of ductile metal which when bent remains in its bent state until again bent, the armature making it possible to change the posture of the figure.

* * * * *